United States Patent [19]

Karlsson

[11] 3,979,038

[45] Sept. 7, 1976

[54] ARRANGEMENT AT TRANSPORT OF WEB OR SHEET MATERIAL

[75] Inventor: Ingemar Karlsson, Vaxjo, Sweden

[73] Assignee: Aktiebolaget Svenska Flaktfabriken, Nacka, Sweden

[22] Filed: May 28, 1975

[21] Appl. No.: 581,668

[30] Foreign Application Priority Data

May 29, 1974 Sweden ..... 7407118

[52] U.S. Cl. ..... 226/97; 34/156

[51] Int. Cl.[2] ..... B65H 17/32

[58] Field of Search ..... 226/7, 97; 34/156

[56] References Cited

UNITED STATES PATENTS

| | | | |
|---|---|---|---|
| 3,272,415 | 9/1966 | Wallin | 226/97 |
| 3,622,058 | 11/1971 | Vits | 226/97 X |
| 3,672,066 | 6/1972 | Stephansen | 34/156 X |

*Primary Examiner*—Richard A. Schacher

*Attorney, Agent, or Firm*—Dorfman, Herrell and Skillman

[57] ABSTRACT

Web or sheet material is carried on air to advance the material in a fixed stable floating position through one or more decks of a treating plant, preferably a drier. Spaced fixing chambers carried out with an air flow substantially parallel to the plane of material are mounted on either side of material and arranged to co-operate with blow boxes carried out for an air flow substantially perpendicular to said material plane, said blow boxes located partly on opposite sides of the material facing the fixing chambers, partly between said chambers.

5 Claims, 3 Drawing Figures

ARRANGEMENT AT TRANSPORT OF WEB OR SHEET MATERIAL

This invention relates to an arrangement at the transport of web or sheet material carried by means of air to advance the material in a fixed, stable floating position without flutter through one or more decks of a treating plant, preferably a drier plant, in such a manner that the air is supplied from a plurality of blow boxes distributed along the conveying path of the material and provided with apertures for air outflow against the material, and thereafter is removed through a plurality of tap apertures provided in the blow boxes or adjacent thereto, which blow boxes are mounted in parallel to each other and perpendicularly to the conveying direction of the material, preferably on both sides of the plane surfaces of the material substantially at equal distance from the plane through the material, and provided on their surface facing toward the material with apertures directed toward the material and designed for blowing the air substantially perpendicularly thereagainst.

In the treatment of web or sheet material, for example when paper or cellulose is dried in driers of the airborne web type, which in the last decades has been the most predominant type, the general technique previously applied has been that the treating medium supplied has to perform in addition the function of carrying and conveying the material over the blow boxes installed on each deck of the treating plant. The blow boxes were in conventional manner provided with one or more rows of air nozzles of a complicated special design and often were expensive to manufacture. It was, however, found that the advantage of being able in such treating plants to advance the material on an airborne path with high conveying speed in too many cases had to be bought at the expense of operation economy, because, for one reason among other, the air supply from the blow boxes had to be carried out as a compromise between the carrying function and the drying-treatment function. Great difficulties were also involved in trying to prevent waviness and flutter of the material, particularly at the two lateral edges thereof. This disadvantage is greatest, of course, when material with coated surfaces is to be advanced through the plant and implies always, aside from tearing risk, a deterioration of the quality of the completely treated material. In order to avoid the aforesaid compromise, recently a design of conveying means was proposed at which a smaller number of fixing chambers are mounted on one side of the material and positioned perpendicularly to the conveying direction of the material, with a greater separation relative to each other than the separation of the blow boxes, and provided with air outflow apertures facing to the plane of the material conveying path and designed so as to produce an air flow in parallel with the plane of both the material and the fixing chamber to stabilize the material to a fixed floating position.

It was found, however, that in conveying means of this kind designed as stated with separate fixing chambers the blow boxes and fixing chambers were so positioned that they would require the sacrifice or loss of a relatively large air effect or air energy per transferred heat amount.

The invention has the object to bring about a new and improved design of an arrangement at the transport of a web or sheet material carried by means of air to advance the material in fixed stable floating position and therewith to utilize an optimum working point in the relation between lost air energy and effective diameter for the apertures of the blow boxes and thereby to produce a plant with improved operation economy and comprising elements for the distribution and supply of the treating medium which are simple and cheap from the mechanical manufacturing aspect.

The arrangement according to the invention is characterized in that the fixing chambers are mounted at a smaller distance from the material than the blow boxes and provided with outflow apertures directed obliquely to the plane of the material, that at least one blow box with apertures distributed over its plane is mounted directly in front of a fixing chamber, and that the tap apertures or exhaust spaces of said blow box for removing the air are entirely or partially closed.

Further characterizing features of the arrangement according to the invention become apparent from the subclaims attached. The invention is described in greater detail in the following, with reference to the accompanying drawings, in which FIG. 1 shows an assembly of the arrangement at a treating plant with two decks.

In the Figures, A-B designate the material of web or sheet shape, and C, C′ designate the lateral edges of the material. The blow boxes disposed above the material are designated by 1, 3 - 23, 25, and the corresponding blow boxes disposed beneath the material are designated by 2, 4 - 20, 22. The arrangement further comprises a plurality of fixing chambers designated by 9′, 17′, and their ejection apertures, which at the embodiment shown are designed as so-called eyelid perforations, are designated by **9*a*′, 9*b*′ and, respectively, 17*a*′, 17*b*′. The fixing chambers are mounted at least on one side of the material. The distance of said chambers from the material is designated by $h_3$ and are supposed to be smaller than the corresponding equal distance of the blow boxes on both sides of the plane material surfaces. The distance of the blow boxes is designated by $h_1$, $h_2$ and their apertures are designated by 11*a*, 11*b*, 11*c* and, respectively, 6*a*, 6*b*, 6*c*. Said apertures are designed for blowing the air substantially perpendicularly onto the material. The separation D of the blow boxes relative to each other is substantially smaller than the separation D′ between the fixing chambers, while the distance of the blow boxes to the material, designated above by $h_1$, $h_2$, is substantially greater than the distance $h_3$ of the fixing chambers. 26, 32, 34 designate entirely free tap apertures or exhaust spaces between the lower blow boxes for air, and corresponding passages between the upper blow boxes and the fixing chamber 9′ are designated by 36–44. As shown, the apertures or spaces between blow boxes located directly in front of a fixing chamber, for example 9′, are plugged. Such plugged tap apertures between blow boxes are designated by 28, 30. Of course, means may be provided to entirely or partially close tap apertures of the type 28, 30. 45, 46 designate holes in a blow box located directly in front of a fixing chamber, for example 9′, 17′**, which hole(s) are disposed outside each lateral edge of C, C′ of the material in order to continuously lift the lateral edges of the web.

Figure 1:
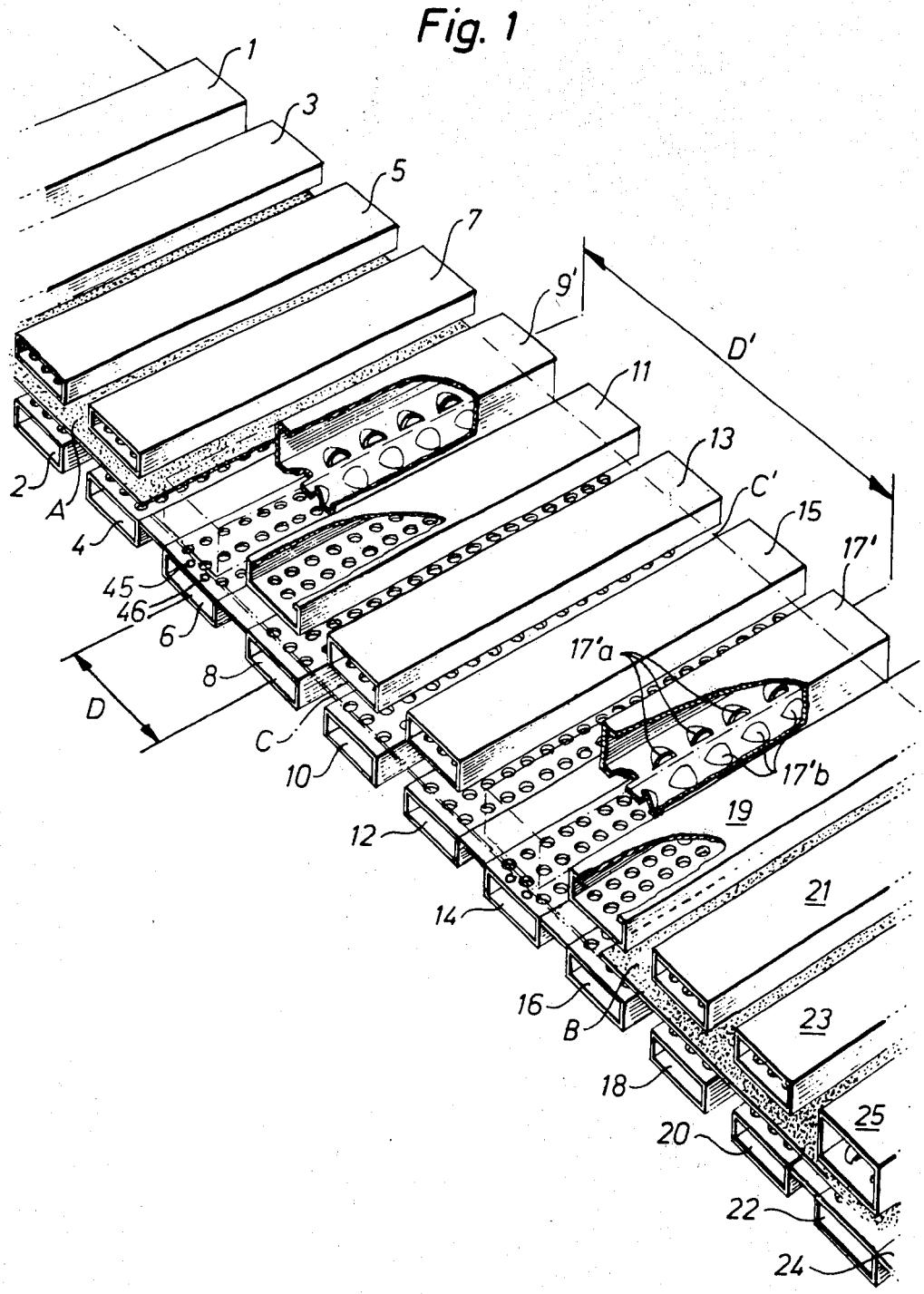
Figure 2:
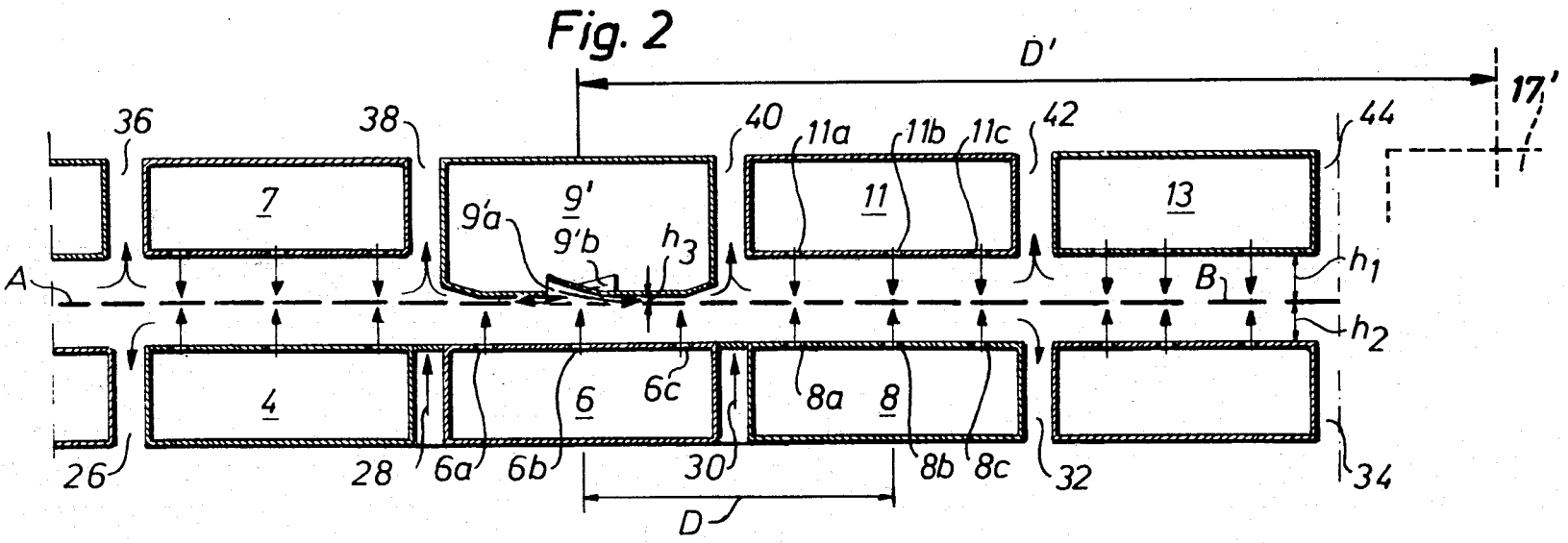
FIG. 2 shows on an enlarged scale the design of blow boxes and, respectively, air supply chambers.
Figure 3:
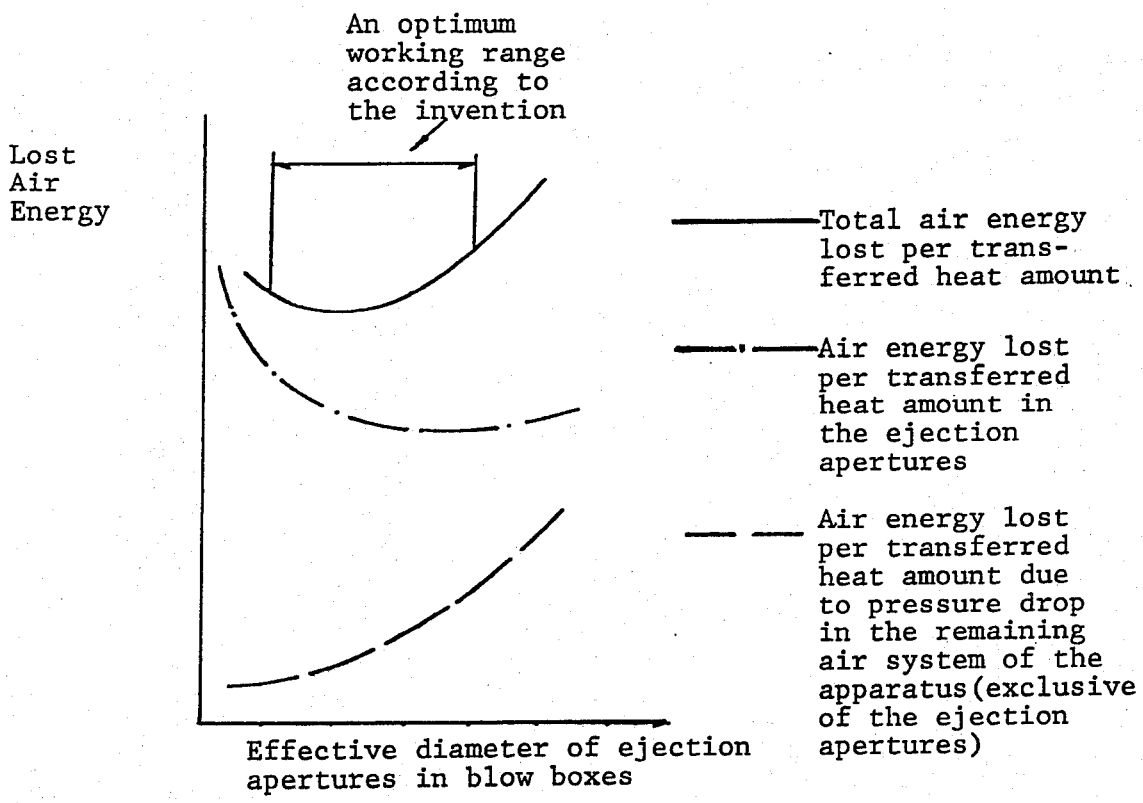
FIG. 3 is a diagram which plots the lost energy against the size of the blow apertures which may be used for determining the optimum range for the size of the blow apertures.

FIG. 3 illustrates the increased loss in energy which results in the remainder of the system when the blow box apertures, 6*a*, 6*b*, 6*c*, 8*a*, 8*b*, 8*c*, 11*a*, 11*b*, 11*c*, etc. are enlarged. This energy loss is the result of a reduction in pressure throughout the system when the aperture sizes increase. The figure also illustrates the energy loss which is due to the constricted character of the apertures. At normal blow box pressures, the throttling loss diminishes as the aperture size increases. When these losses are combined, it is possible to select an optimum range for the diameters of the apertures.

I claim:

1. An apparatus for the transport of web or sheet material carried on air to advance the material in a fixed stable floating position without flutter in a conveying path through one or more decks of a treating plant having air supply means comprising a plurality of blow boxes distributed along the conveying path of the material and provided with apertures for air outflow against the material, and air exhaust means comprising a plurality of exhaust spaces provided adjacent the blow boxes, which blow boxes are mounted in spaced parallel relation with each other and perpendicularly to the conveying direction of the material on both sides of the plane surfaces of the material at substantially equal distances from the plane through the material, and having plane surfaces facing toward the material with apertures directed against the material and designed to blow the air substantially perpendicularly against the material, and a smaller number of fixing chambers mounted at least on one side of the material and disposed perpendicularly to the conveying direction of the material with a separation relative to each other along the conveying path exceeding the separation of the blow boxes, which chambers are provided with air outflow apertures directed against the plane of the material to bring about an air flow in parallel with the plane of both the material and the fixing chamber, characterized in that the fixing chambers are mounted at a smaller distance from the conveying path than the blow boxes and are provided with outflow apertures directed obliquely to the plane of the conveying path, and that at least one blow box with apertures distributed over its plane is mounted directly in front of a fixing chamber, and that exhaust spaces adjacent said one blow box are entirely or partially closed.

2. An apparatus as defined in claim 1, wherein said blow boxes are mounted on both sides of the material and have apertures in the form of a plurality of circular holes for ejecting air perpendicularly against the material, characterized in that at least a part of the fixing chambers are provided with outflow apertures in the form of one or more co-operating pairs of apertures for ejecting air in two straight opposite directions in parallel with the plane of both the material and fixing chamber.

3. An apparatus as defined in claim 1, wherein said blow boxes are mounted on both sides of the material and have apertures in the form of a plurality of circular holes for ejecting air perpendicularly against the material, characterized in that at least a part of the fixing chambers are provided with apertures for ejecting air in only one direction in parallel with the plane of both the material and fixing chamber.

4. An apparatus as defined in claim 1 characterized in that the outflow apertures of each fixing chamber are designed as eyelid perforations.

5. An apparatus as defined in claim 1 providing horizontal transport of a web material through at least one passage of a treating plant, and having at least one fixing chamber mounted on one side of the material web in said passage, characterized in that the blow box means disposed on the opposite side of the material web directly in front of said fixing chamber is provided with at least one outflow aperture located outside each lateral edge of the web material to continuously lift each lateral edge of the web.

* * * * *